US010850947B2

(12) United States Patent
Park

(10) Patent No.: US 10,850,947 B2
(45) Date of Patent: Dec. 1, 2020

(54) MISALIGNMENT MONITORING IN A PEOPLE CONVEYOR

(71) Applicant: Otis Elevator Company, Farmington, CT (US)

(72) Inventor: Chan-Jong Park, Vienna (AT)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 16/518,622

(22) Filed: Jul. 22, 2019

(65) Prior Publication Data

US 2020/0031630 A1 Jan. 30, 2020

(30) Foreign Application Priority Data

Jul. 27, 2018 (EP) ..... 18186065

(51) Int. Cl.

| | |
|---|---|
| ***B66B 25/00*** | (2006.01) |
| ***B66B 23/02*** | (2006.01) |
| ***B66B 23/14*** | (2006.01) |
| ***B66B 27/00*** | (2006.01) |
| ***B66B 21/02*** | (2006.01) |
| ***B66B 21/10*** | (2006.01) |

(52) U.S. Cl.

CPC ..... *B66B 25/006* (2013.01); *B66B 23/02* (2013.01); *B66B 23/14* (2013.01); *B66B 27/00* (2013.01); *B66B 21/02* (2013.01); *B66B 21/10* (2013.01)

(58) Field of Classification Search

USPC ..... 198/321–338

See application file for complete search history.

(56) References Cited

U.S. PATENT DOCUMENTS

| | | | | |
|---|---|---|---|---|
| 3,677,388 | A * | 7/1972 | Boltrek | B66B 23/02 198/833 |
| 4,397,096 | A | 8/1983 | Kraft et al. | |
| 4,535,880 | A * | 8/1985 | Boltrek | B66B 23/028 198/330 |
| 4,676,560 | A * | 6/1987 | Schmitz | B65G 1/127 312/268 |
| 5,785,165 | A | 7/1998 | Stahlhut et al. | |

(Continued)

FOREIGN PATENT DOCUMENTS

| | | | |
|---|---|---|---|
| CN | 101370729 | A | 2/2009 |
| CN | 203728384 | U | 7/2014 |
| CN | 104276505 | A | 1/2015 |

(Continued)

OTHER PUBLICATIONS

European Search Report for application 18186065.1, dated Apr. 11, 2019, 5 pages.

*Primary Examiner* — William R Harp
(74) *Attorney, Agent, or Firm* — Cantor Colburn LLP

(57) ABSTRACT

A people conveyor (1) comprises a truss (2) extending between two landing portions (20, 21); a band (12) of conveyance elements (13) forming a closed loop extending in a conveyance direction between the two landing portions (20, 21); a drive machine (25) configured for driving the band (12) of conveyance elements (13); and at least two magneto-inductive sensors (36*a*, 36*b*, 36*c*) mounted to the truss (2). The at least two magneto-inductive sensors (36*a*, 36*b*, 36*c*) are configured for providing sensor signals which allow determining the position and orientation of the drive machine (25) with respect to the truss (2).

17 Claims, 4 Drawing Sheets

(56) References Cited

U.S. PATENT DOCUMENTS 6,435,035 B1 8/2002 Kubsik et al.

FOREIGN PATENT DOCUMENTS

| | | | |
|---|---|---|---|
| CN | 204714304 | U | 10/2015 |
| CN | 206569890 | U | 10/2017 |
| CN | 206680048 | U | 11/2017 |
| CN | 207078895 | U | 3/2018 |
| DE | 202006009483 | U1 | 8/2006 |
| EP | 1850105 | A1 | 10/2007 |
| EP | 3199484 | A1 | 8/2017 |
| JP | 2004026356 | A | 1/2004 |
| JP | 2008094579 | A | 4/2008 |
| JP | 4820769 | B2 | 11/2011 |
| JP | 2012006721 | A | 1/2012 |
| JP | 6188896 | B1 | 8/2017 |

* cited by examiner

MISALIGNMENT MONITORING IN A PEOPLE CONVEYOR

FOREIGN PRIORITY

This application claims priority to European Patent Application No. 18186065.1, filed Jul. 27, 2018, and all the benefits accruing therefrom under 35 U.S.C. § 119, the contents of which in its entirety are herein incorporated by reference.

BACKGROUND

The invention relates to a people conveyor with a drive machine and sensors for monitoring misalignment of the drive machine.

People conveyors such as escalators and moving walkways comprise a band of conveyance elements, such as steps or pallets, moving in a conveyance direction. The band of conveyance elements is driven by a drive machine. The driving force provided by the drive machine is usually transmitted to the band of conveyance elements by a transmission element, in particular by a tension element, such as a drive chain or drive belt, engaging with a drive member of the drive machine. The drive machine needs to be arranged properly in order to allow for a smooth transmission of the driving force.

Misalignment of the drive machine results in increased wear of the transmission element reducing the lifetime of the transmission element and increasing the risk of breaking the transmission element. It further increases the frictional losses reducing the efficiency of the drive machine.

It would be beneficial to be able to reliably and conveniently detect misalignment of a drive machine employed in a people conveyor.

BRIEF DESCRIPTION

According to an exemplary embodiment of the invention, a people conveyor comprises a truss extending between two landing portions; a band of conveyance elements forming a closed loop extending between the two landing portions; a drive machine configured for driving the band of conveyance elements; and at least two magneto-inductive sensors mounted to the truss. The at least two magneto-inductive sensors are configured for providing sensor signals which allow determining the position and orientation of the drive machine with respect to the truss.

A method of operating a people conveyor according to an exemplary embodiment of the invention includes determining the position and/or the orientation of the drive machine with respect to the truss based on sensor signals provided by the at least two magneto-inductive sensors.

The sensor signals provided by the at least two magneto-inductive sensors allow determining the position and/or orientation of the drive machine with respect to the truss with high accuracy and at low costs. Misalignments of the drive machine in particular may be detected continuously or periodically during operation of the people conveyor. In consequence, misalignments of the drive machine may be reliably detected at an early stage of deviation. As a result, excessive wear or even damage of the drive system, in particular the transmission element and/or the drive member may be prevented by realigning the drive machine and/or by stopping any further operation of the people conveyor until the drive machine has been realigned.

The at least two magneto-inductive sensors may be employed in newly installed people conveyors. At least two magneto-inductive sensors also may be added to existing people conveyors in order to allow monitoring the position and orientation of the drive machine of existing people conveyors as well.

For enhancing the reliability and accuracy of the detection, the people conveyor may further comprise at least two permanent-magnets. Each of the at least two permanent-magnets may be attached to a surface of the drive machine at a position opposite to one of the magneto-inductive sensors for being detected by one of the at least two magneto-inductive sensors, respectively.

The magneto-inductive sensors in particular may be configured for detecting a distance between a respective magneto-inductive sensor and a corresponding permanent-magnet attached to the drive machine. The position and orientation of the drive machine with respect to the truss may be determined, in particular calculated, from said detected distances.

The at least two magneto-inductive sensors may be arranged at the same height in a vertical direction. The at least two magneto-inductive sensors may be spaced apart from each other in a horizontal direction in order to allow detecting a misalignment of the drive machine within a horizontally extending plane, in particular a misalignment in a direction oriented orthogonally to the extension of the transmission element and/or the conveyance direction.

The at least two magneto-inductive sensors may be configured for detecting a misalignment of the drive machine with respect to a vertical plane. The at least two magneto-inductive sensors in particular may be spaced apart from each other in the vertical direction.

In a further configuration, the at least two magneto-inductive sensors may be spaced apart from each other in the horizontal direction and in the vertical direction.

The drive machine may comprise a drive member, such as a drive sprocket or a drive sheave, which is driven by a motor of the drive machine. The drive member may be in engagement with the transmission element, e.g. a drive chain or drive belt, which is configured for driving the band of conveyance elements.

The people conveyor may comprise a controller configured for receiving the sensor signals from the at least two magneto-inductive sensors and for determining the position and/or orientation of the drive machine and/or the drive member from the received sensor signals.

The controller may be configured for determining a lateral position of the drive machine and/or the drive member, i.e. the position of the drive machine and/or the drive member in a direction which is oriented parallel to a rotation axis of the drive member and/or orthogonally to a plane in which the transmission member extends. Said plane in particular may extend parallel to the conveyance direction of the people conveyor.

Alternatively or additionally, the controller may be configured for determining an inclination of the drive machine and/or the rotation axis of the drive member with respect to a predefined orientation. When the drive machine is oriented in the predefined orientation, the rotation axis of the drive member in particular is oriented orthogonally to the plane in which the transmission member is configured to extend.

The controller in particular may be configured for determining an inclination of the drive machine and/or a rotation axis of the drive member in a horizontal plane and/or from a vertical plane.

In order to avoid excessive wear or even damage of the drive member and/or of the transmission element, the controller may be configured for determining a deviation of the determined position of the drive machine and/or of the drive member from a predefined position. The controller further may be configured for issuing an alarm signal and/or for stopping the drive machine when the absolute value of said deviation exceeds a predetermined limit.

In order to avoid excessive wear or even damage of the drive machine and/or of the transmission element, the controller may be configured for determining a deviation of the determined orientation of the drive machine and/or of the drive member from a predefined orientation. The controller further may be configured for issuing an alarm signal and/or for stopping the drive machine when the absolute value of said deviation exceeds a predetermined limit.

The people conveyor may comprise three magneto-inductive sensors attached to the truss and configured for detecting the position and orientation of the drive machine with respect to the truss.

The three magneto-inductive sensors may be arranged in a common virtual plane in a configuration in which they are not arranged on a common straight line. Instead, the three magneto-inductive sensors may constitute the corners of a virtual rectangular triangle. The common virtual plane may extend orthogonally to the rotation axis of the drive member and/or parallel to the plane in which the transmission element extends.

A configuration comprising three magneto-inductive sensors allows determining the inclination (angular misalignment) of the drive machine, in particular a misalignment of the rotation axis of the drive member, not only in one dimension, e.g. the horizontal dimension, but also in a second dimension, e.g. from a vertical direction, which is oriented non-parallel, in particular orthogonally, with respect to the first dimension.

The people conveyor may be an escalator in which the conveyance elements are steps. Alternatively, the people conveyor may be a moving walkway in which the conveyance elements are pallets. In case of a moving walkway, the band of conveyance elements (pallets) may be inclined with respect to the horizontal, or it may extend horizontally.

The method of operating a people conveyor may include determining a deviation of the determined position of the drive machine and/or of the drive member from a predefined position, and issuing an alarm signal when the absolute value of said deviation exceeds a predetermined alarm limit.

The method in particular may include determining a deviation of the determined position of the drive machine and/or of the drive member from a predefined position, and issuing an alarm signal when said the absolute value of deviation exceeds a predetermined alarm limit.

Alternatively or additionally, the method may include determining a deviation of the determined position of the drive machine and/or of the drive member from the predefined position, and stopping the drive machine when the absolute value of said deviation exceeds a predetermined stop limit. The stop limit may be larger than the alarm limit so that the alarm signal is issued before the operation of the people conveyor needs to be stopped. This allows realigning the drive machine at an early stage of deviation without interrupting the operation of the people conveyor for a long period of time.

For setting appropriate reference distances corresponding to the predefined position, the method may include determining the distances of the drive machine with respect to the truss based on sensor signals provided by the at least two magneto-inductive sensors while the drive machine is properly aligned, and storing said distances as reference distances.

DRAWING DESCRIPTION

In the following, exemplary embodiments of the invention are described with reference to the enclosed figures.

DETAILED DESCRIPTION

Figure 1:
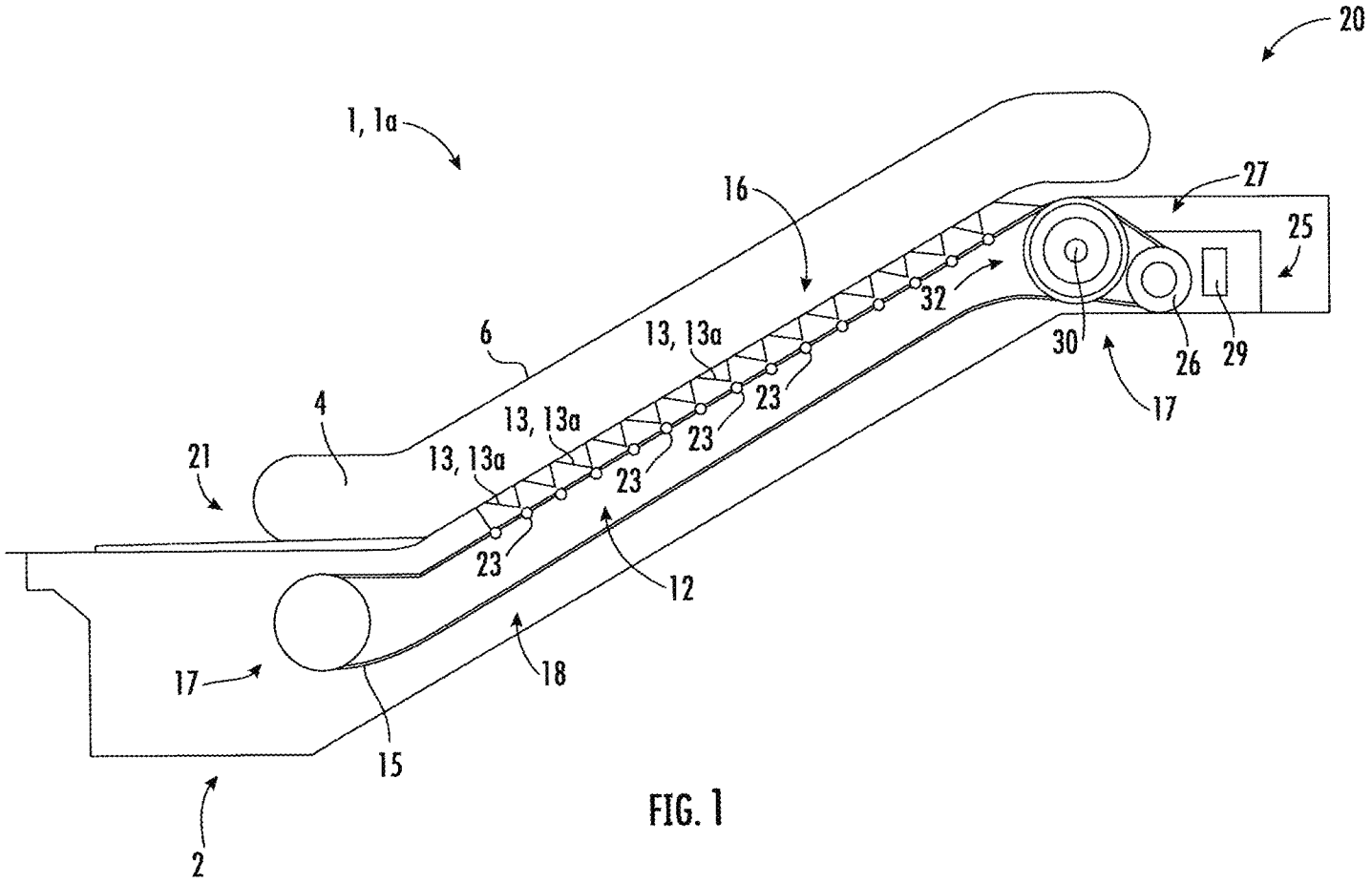
FIG. 1 depicts a schematic side view of an escalator.

FIG. 1 depicts a schematic side view of a people conveyor 1, in particular of an escalator 1*a*, comprising a truss 2 and a band 12 of conveyance elements 13 (steps 13*a*) extending in a longitudinal conveyance direction between two landing portions 20, 21. The conveyance elements 13 comprise rollers 23 guided and supported by guide rails (not shown). For clarity, only some of the conveyance elements 13 are depicted in FIG. 1, and not all conveyance elements 13/rollers 23 are provided with reference signs.

In turnaround portions 17 next to the landing portions 20, 21, the band 12 of conveyance elements 13 passes from an upper conveyance portion 16 into a lower return portion 18, and vice versa. A conveyance chain 15 extending along a closed loop is connected to the band 12 of conveyance elements 13.

The conveyance chain 15 is configured for driving the band 12 of conveyance elements 13. The conveyance chain 15 is driven by a conveyance sprocket or sheave 32 mounted to a rotating shaft 30. A drive machine 25 comprising a motor 29 is configured for driving the rotating shaft 30 and in consequence the conveyance sprocket or sheave 32 and the conveyance chain 15 via a transmission element 27.

The transmission element 27 may be a drive chain or drive belt engaging with a drive member (drive sprocket or sheave) 26 of the drive machine 25 and the conveyance sprocket or sheave 32 mounted to a rotating shaft 30. In such a configuration, the conveyance sprocket or sheave 32 may comprise two gear rims (not shown), a first gear rim engaging with the conveyance chain 15, and a second gear rim engaging with the transmission element 27. The first and second gear rims may have the same diameter/number of teeth, or the diameters/numbers of teeth of the two gear rims may be different.

Balustrades 4 supporting moving handrails 6 extend parallel to the conveyance portion 16.

Figure 2:
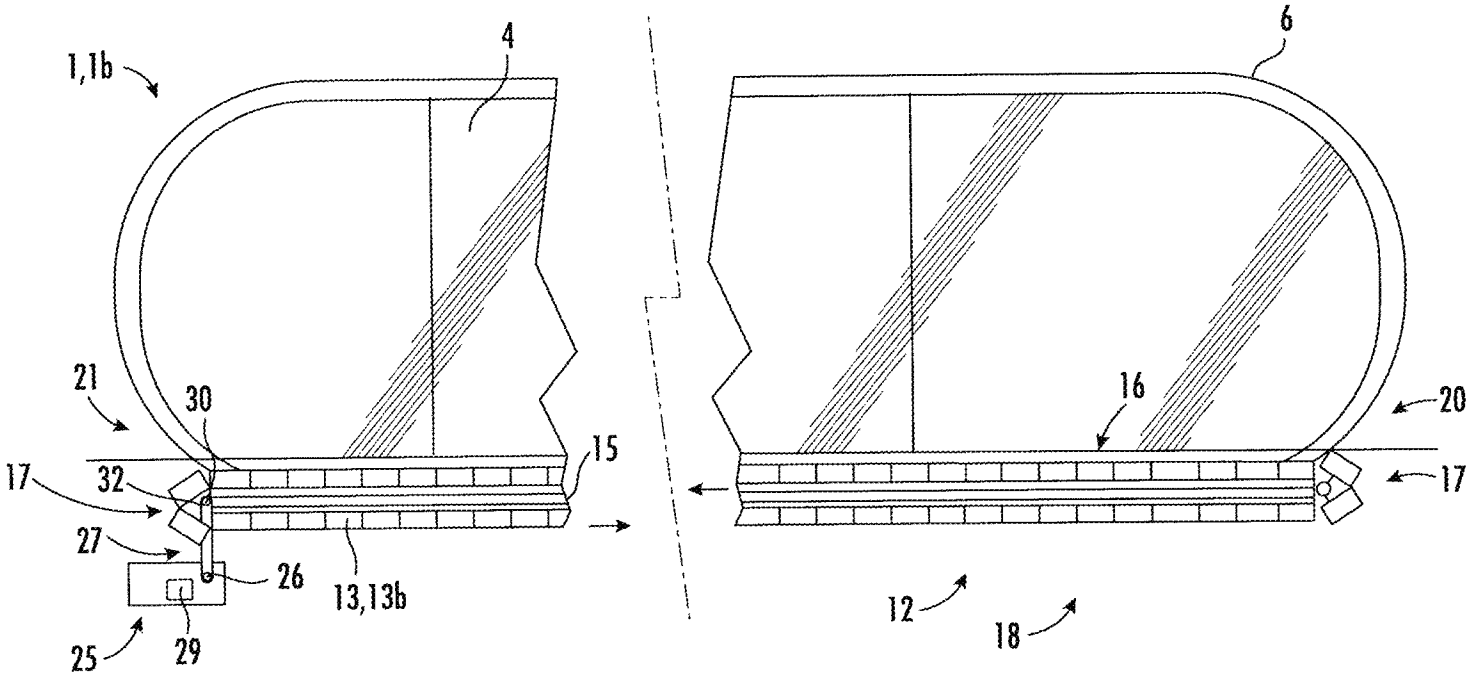
FIG. 2 depicts a schematic side view of a moving walkway.

FIG. 2 depicts a schematic side view of a people conveyor 1, which is provided as a moving walkway 1*b*.

The moving walkway 1*b* comprises a supporting truss (not shown in FIG. 2), and an endless band 12 of conveyance elements 13 (pallets 13*b*) moving in a longitudinal conveyance direction in an upper conveyance portion 16 and opposite to the conveyance direction in a lower return portion 18. Landing portions 20, 21 are provided at both ends of the moving walkway 1*b*. In turnaround portions 17 next to the landing portions 20, 21 the band 12 of conveyance elements 13 passes from the conveyance portion 16 into the return portion 18, and vice versa. Balustrades 4 supporting moving handrails 6 extend parallel to the conveyance portion 16.

Similar to the embodiment shown in FIG. 1, the band 12 of conveyance elements 13 is connected with an endless conveyance chain 15. In at least one of the turnaround portions 17, the endless conveyance chain 15 is in engagement with a conveyance sprocket or sheave 32. When the moving walkway 1*b* is operated, the conveyance sprocket or sheave 32 is driven by a motor 29 of a drive machine 25 via a transmission element 27 for driving the band 12 of conveyance elements 13.

The transmission element 27 may be a drive chain or drive belt engaging with a drive member (drive sprocket or sheave) 26 of the drive machine 25 and the conveyance sprocket or sheave 32 mounted to a rotating shaft 30. In such a configuration, the conveyance sprocket or sheave 32 may comprise two gear rims (not shown), a first gear rim engaging with the conveyance chain 15 and a second gear rim engaging with the transmission element 27. The first and second gear rims may have the same diameter/number of teeth, or the diameters/numbers of teeth of the two gear rims may be different.

Figure 3:
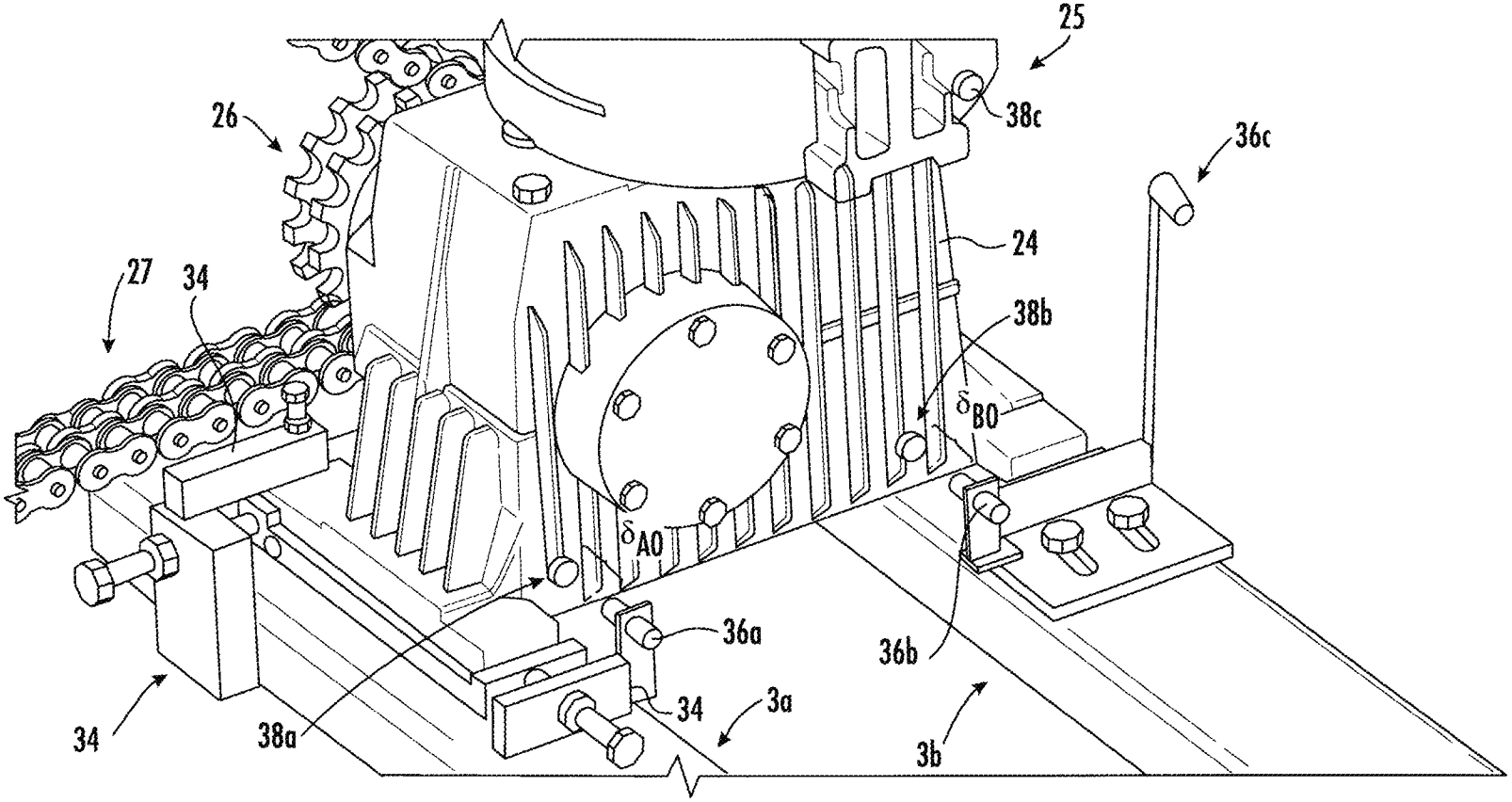
FIG. 3 depicts a perspective view of the drive machine.
Figure 4:
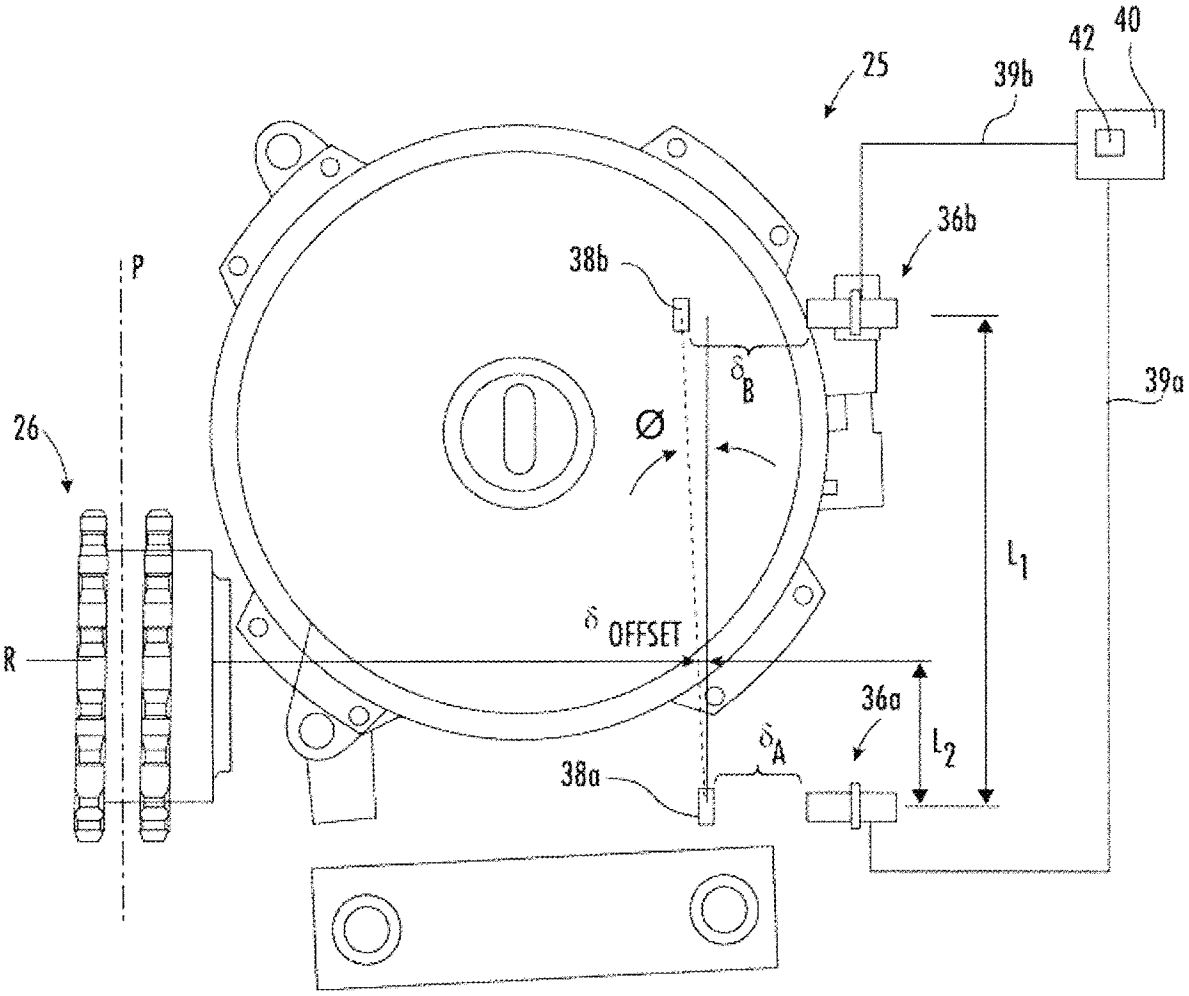
FIG. 4 depicts a top view of the drive machine.

FIG. 3 shows a perspective view of the drive machine 25, and FIG. 4 shows a top view thereof. The drive machine 25 may be a drive machine 25 of an escalator 1*a* as depicted in FIG. 1, or of a moving walkway 1*b* as depicted in FIG. 2.

The drive machine 25 is mounted to and supported by two bars 3*a*, 3*b* of the truss 2. The two bars 3*a*, 3*b* are the only components of the truss 2 shown in FIG. 3. No parts of the truss 2 are depicted in FIG. 4.

In the embodiment depicted in FIGS. 3 and 4, the transmission element 27 is a double drive chain engaging with a double drive member 26. The double drive chain is depicted only in FIG. 3, but not in FIG. 4. The skilled person understand that employing a double drive chain is only an example and that alternative transmission elements 27, e.g. a single chain or a toothed belt (not shown), may be used instead.

A plurality of mechanical adjustment mechanisms 34 are mounted to the bars 3*a*, 3*b* of the truss 2. The mechanical adjustment mechanisms 34 allow adjusting the position of the drive machine 25 with respect to the bars 3*a*, 3*b* in order to align the drive member 26 at the desired position and with the proper orientation allowing a smooth engagement of the transmission element 27 with the drive member 26.

When the drive machine 25 is arranged and oriented properly, a rotation axis R of the drive member 26 extends orthogonally to a plane P in which the transmission element 27 is configured to extend.

Two magneto-inductive sensors 36*a*, 36*b* facing a side surface 24 (see FIG. 3) of the drive machine 25 are mounted to the bars 3*a*, 3*b*. The magneto-inductive sensors 36*a*, 36*b* are configured for detecting the distances $\delta_A$, $\delta_B$ between the respective magneto-inductive sensor 36*a*, 36*b* and the opposing side surface 24 of the drive machine 25, respectively.

The magneto-inductive sensors 36*a*, 36*b* in particular are configured for detecting their respective distances $\delta_A$, $\delta_B$ from corresponding permanent-magnets 38*a*, 38*b* attached to the side surface 24 of the drive machine 25 facing the magneto-inductive sensors 36*a*, 36*b*.

The magneto-inductive sensors 36*a*, 36*b* and the corresponding permanent-magnets 38*a*, 38*b* are arranged at the same height in a vertical direction, and they are spaced apart from each other in a distance $L_1$ in a horizontal direction.

The first magneto-inductive sensor 36*a* and the corresponding permanent-magnet 38*a* are arranged in a distance $L_2$ from the rotation axis R of the drive member 26 in the horizontal direction.

The people conveyor 1 further comprises a controller 40 (see FIG. 4). The controller 40 is electrically connected with the magneto-inductive sensors 36*a*, 36*b* by signal lines 39*a*, 39*b* for receiving sensor signals from the magneto-inductive sensors 36*a*, 36*b*. The controller 40 is configured for determining the position and/or the orientation of the drive machine 25 and/or of the drive member 26 with respect to the truss 2 by analyzing the sensor signals received from the magneto-inductive sensors 36*a*, 36*b*.

After the drive machine 25 has been properly aligned, e.g. after installation and/or maintenance of the people conveyor 1, the controller 40 may be initialized by detecting the distances $\delta_A$, $\delta_B$ between the magneto-inductive sensors 36*a*, 36*b* and the corresponding permanent-magnets 38*a*, 38*b* in said properly aligned configuration, and by storing said distances $\delta_A$, $\delta_B$ as reference distances $\delta_{A0}$, $\delta_B$ in a memory 42 of the controller 40.

During the following operation of the people conveyor 1, the controller 40 continuously or periodically determines the current actual distances $\delta_A$, $\delta_B$ between the magneto-inductive sensors 36*a*, 36*b* and the corresponding permanent-magnets 38*a*, 38*b* from the received sensor signals. Based on this information, the controller 40 determines the current position and orientation of the drive machine 25 and/or of the drive member 26 with respect to the truss 2.

The controller 40 in particular may be configured for calculating deviations (differences) ΔA, ΔB of the actual distances $\delta_A$, $\delta_B$ from the reference distances $\delta_{A0}$, $\delta_{B0}$:

$$\Delta A = \delta_A - \delta_{A0}$$

$$\Delta B = \delta_B - \delta_B 0$$

From these deviations ΔA, ΔB, the controller 40 may further determine the angular misalignment Ø of the drive machine from the predefined orientation:

$$\phi = \tan^{-1}\left(\frac{\Delta B - \Delta A}{L_1}\right)$$

and the lateral offset $\delta_{offset}$ of the drive member 26 along its rotation axis R from the predefined position.

$$\delta_{offset} = L_2 \times \tan \phi.$$

The deviations ΔA, ΔB, the misalignment Ø and/or the lateral offset $\delta_{offset}$ may be compared to corresponding predefined limits stored within the memory 42 of the controller 40. The controller 40 in particular may be configured for issuing an alarm signal in case at least one of the predefined limits is exceeded by the absolute value of at least one of the deviations ΔA, ΔB, the misalignment Ø and the lateral offset $\delta_{offset}$, respectively.

For example, issuing a first alarm signal (maintenance signal) may cause a mechanic to visit the people conveyor 1 in order to realign the drive machine 25. Alternatively or additionally, a second alarm signal (stop signal) may stop operating the drive machine 25.

At least two limits may be assigned to at least one of the deviations ΔA, ΔB, the misalignment Ø and/or the lateral offset $\delta_{offset}$, respectively. The at least two limits may include a lower limit and an upper limit, which is larger than the lower limit.

A mechanic may be ordered to visit the people conveyor 1 for realigning the drive machine 25 in case at least one of the lower limits (maintenance limits) is exceeded by the absolute value of at least one of the deviations ΔA, ΔB, the misalignment Ø and/or the lateral offset $\delta_{offset}$, respectively.

Any further operation of the people conveyor 1 may be stopped in order to avoid (further) damage of the people conveyor 1, in particular of the transmission element 27 and/or the drive member 26, in case at least one of the upper limits (stop limits) is exceeded by the absolute value of at least one of the deviations ΔA, ΔB, the misalignment Ø and/or the lateral offset $\delta_{offset}$, respectively.

In a further (optional) configuration, the people conveyor 1 comprises at least one additional (third) magneto-inductive sensor 36*c* and at least one corresponding additional (third) permanent-magnet 38*c* attached to the side surface 24 of the drive machine 25 facing the additional magneto-inductive sensor 36*c* (See FIG. 3).

Three magneto-inductive sensors 36*a*, 36*b* 36*c* may be arranged in a common virtual plane extending parallel to a side surface 24 of the drive machine 25.

The three magneto-inductive sensors 36*a*, 36*b* 36*c* may be arranged in a configuration in which they are not arranged on a common straight line, the three magneto-inductive sensors 36*a*, 36*b* 36*c* in particular may be arranged on the corners of a virtual rectangular triangle.

Such a configuration comprising at least three magneto-inductive sensors 36*a*, 36*b* 36*c* allows determining the inclination (angular misalignment) of the drive machine 25 not only in one dimension, in particular in the horizontal dimension, as described before, but also in a second dimension. It in particular allows determining deviation from a vertical plane, which is oriented orthogonally with respect to the first dimensions.

While the invention has been described with reference to exemplary embodiments, it will be understood by those skilled in the art that various changes may be made and equivalents may be substituted for elements thereof without departing from the scope of the invention. In addition, many modifications may be made to adopt a particular situation or material to the teachings of the invention without departing from the essential scope thereof. Therefore, it is intended that the invention is not limited to the particular embodiments disclosed, but that the invention includes all embodiments falling within the scope of the claims.

REFERENCES

1 people conveyor
1*a* escalator
1*b* moving walkway
2 truss
3*a*, 3*b* bars of the truss
4 balustrade
6 moving handrail
12 band of conveyance elements
13 conveyance elements
13*a* steps
13*b* pallets
15 conveyance chain
16 conveyance portion
17 turnaround portion
18 return portion
20, 21 landing portions
23 rollers
24 side surface of the drive machine
25 drive machine
26 drive member
27 transmission element
29 motor
30 rotating shaft
32 conveyance sprocket or sheave
34 mechanical adjustment mechanism
36*a*, 36*b*, 36*c* magneto-inductive sensors
38*a*, 38*b*, 38*c* permanent-magnets
39*a*, 39*b* signal lines
40 controller
42 memory
L1 distance between magneto-inductive sensors in the horizontal direction
L2 distance between the first magneto-inductive sensor and center of the drive sprocket
R rotation axis
$\delta_A$, $\delta_B$ distances between the magneto-inductive sensors and the corresponding permanent-magnets
$\delta_{A0}$, $\delta_{B0}$ reference distances
$\delta_{offset}$ lateral offset of the drive machine
Ø angular misalignment of the drive machine

What is claimed is:

1. People conveyor comprising:
a truss extending between two landing portions;
a band of conveyance elements forming a closed loop extending in a conveyance direction between the two landing portions;
a drive machine configured for driving the band of conveyance elements; and
at least two magneto-inductive sensors mounted to the truss and configured for detecting the position and/or the orientation of the drive machine with respect to the truss.

2. People conveyor according to claim 1 comprising at least two permanent-magnets, wherein each of the at least two permanent-magnets, is attached to the drive machine at a position opposite to one of the at least two magneto-inductive sensors, respectively.

3. People conveyor according to claim 1, wherein the at least two magneto-inductive sensors are spaced apart from each other in a horizontal direction and/or in a vertical direction.

4. People conveyor according to claim 1, wherein the at least two magneto-inductive sensors are arranged at the same height in a vertical direction.

5. People conveyor according to claim 1, wherein the drive machine comprises a drive member configured to be driven by the drive machine and in engagement with a transmission element.

6. People conveyor according to claim 5, wherein the drive member comprises a drive chain configured to drive the band of conveyance elements.

7. People conveyor according to claim 1, further comprising a controller configured for receiving sensor signals from the at least two magneto-inductive sensors and for determining the position and/or orientation of the drive machine from the received sensor signals.

8. People conveyor according to claim 7, wherein the controller is configured for determining a lateral position of the drive machine and/or an inclination of the drive machine with respect to a predefined orientation.

9. People conveyor according to claim 7, wherein the controller is configured for determining a deviation of the determined position/orientation of the drive machine from a predefined position/orientation of the drive machine, wherein the controller is further configured for issuing an alarm signal and/or for stopping the drive machine when the absolute value of said deviation exceeds a predetermined limit.

10. People conveyor according to claim 1, wherein the people conveyor comprises three magneto-inductive sensors attached to the truss and configured for detecting the position and orientation of the drive machine with respect to the truss.

11. People conveyor according to claim 10, wherein the three magneto-inductive sensors are arranged in a common virtual plane.

12. People conveyor according to claim 10, wherein the three magneto-inductive sensors are not arranged on a common straight line.

13. People conveyor according to claim 12, wherein the three magneto-inductive sensors are arranged on the corners of a virtual rectangular triangle.

14. People conveyor according to claim 1, wherein the people conveyor is an escalator (1*a*) and the conveyance elements are steps, or wherein the people conveyor is a moving walkway (1*b*) and the conveyance elements are pallets.

15. Method of operating a people conveyor according to claim 1, wherein the method includes determining the position and/or the orientation of the drive machine with respect to the truss based on sensor signals provided by the at least two magneto-inductive sensors.

16. Method of claim 15, wherein the method includes determining a difference between the determined position of the drive machine and a predefined position of the drive machine, wherein the method further includes issuing an alarm signal when the absolute value of said difference exceeds a predetermined alarm limit and/or stopping the drive machine when the absolute value of said difference exceeds a predetermined stop limit.

17. Method of initializing a people conveyor according to claim 1, wherein the method includes determining the distances ($\delta_A$, $\delta_B$) of the drive machine with respect to the truss based on sensor signals provided by the at least two magneto-inductive sensors while the drive machine is properly aligned, and storing said distances ($\delta_A$, $\delta_B$) as reference distances ($\delta_{A0}$, $\delta_{B0}$).

* * * * *